US012687003B1

(12) United States Patent
Crowley et al.

(10) Patent No.: US 12,687,003 B1
(45) Date of Patent: Jul. 21, 2026

(54) TOILET RING DEVICE

(71) Applicants: William Crowley, Freetown, MA (US); David Jay Barnard, Piedmont, SC (US)

(72) Inventors: William Crowley, Freetown, MA (US); David Jay Barnard, Piedmont, SC (US)

( * ) Notice: Subject to any disclaimer, the term of this patent is extended or adjusted under 35 U.S.C. 154(b) by 0 days.

(21) Appl. No.: 18/206,044

(22) Filed: Jun. 5, 2023

Related U.S. Application Data

(60) Provisional application No. 63/410,035, filed on Sep. 26, 2022, provisional application No. 63/348,887, filed on Jun. 3, 2022.

(51) Int. Cl.
*E03D 11/16* (2006.01)

(52) U.S. Cl.
CPC ..... *E03D 11/16* (2013.01)

(58) Field of Classification Search
CPC ..... E03D 11/16
See application file for complete search history.

(56) References Cited

U.S. PATENT DOCUMENTS 4,907,301 A 3/1990 Tucker
5,220,694 A * 6/1993 Knorovsky ..... E03D 11/16 4/252.4
6,026,521 A 2/2000 Atkins
6,115,852 A 9/2000 Olivas
6,155,606 A * 12/2000 Phillips ..... F16L 23/032 285/59
6,416,084 B1 7/2002 Mantyla
6,751,812 B2 6/2004 Malloy
10,669,707 B2 * 6/2020 Schuster ..... E03D 11/17
D941,444 S 1/2022 Smith et al.
11,519,162 B1 * 12/2022 Amendariz ..... E03D 11/16
(Continued)

*Primary Examiner* — Janie M Loeppke
(74) *Attorney, Agent, or Firm* — John Rizvi; John Rizvi, P.A.—The Patent Professor®

(57) ABSTRACT

A toilet ring device comprises a circular plate, an outer circular wall, an inner circular wall, a central hole, an annular channel, a plurality of holes and slots. The circular plate, the outer circular wall and the inner circular wall are configured to cover an existing toilet flange. The outer circular wall is connected with the circular plate. The outer circular wall is erected from the circular plate. The outer circular wall extends along an outer periphery of the circular plate. The central hole traverses through the circular plate. The central hole is configured to be aligned with central holes of the existing toilet flange and a toilet. The inner circular wall is connected with the circular plate. The inner circular wall is erected from the circular plate. The inner circular wall extends along a periphery of the central hole. The annular channel is formed between the circular plate, the outer circular wall and the inner circular wall. The annular channel is delineated by the circular plate, the outer circular wall and the inner circular wall. The plurality of holes and slots traverse through the circular plate. The plurality of holes and slots are distributed on the circular plate. The plurality of holes and slots surround the central hole. The annular channel is configured to receive the existing toilet flange. The plurality of holes and slots are configured to be aligned with holes and slots of the existing toilet flange and the toilet.

8 Claims, 6 Drawing Sheets

(56) References Cited

U.S. PATENT DOCUMENTS

| | | | | |
|---|---|---|---|---|
| 2006/0213003 | A1 | 9/2006 | Hughes | |
| 2007/0186336 | A1 | 8/2007 | Gately | |
| 2013/0340156 | A1* | 12/2013 | McHale | E03D 11/18 4/420 |

* cited by examiner

TOILET RING DEVICE

CROSS-REFERENCE TO RELATED APPLICATIONS

This application claims the benefit of U.S. Provisional Patent Application 63/348,887 and No. 63/410,035, filed on Jun. 3, 2002 and Sep. 26, 2022, respectively, which is incorporated by reference herein in its entirety.

FIELD OF THE INVENTION

The present invention relates generally to a toilet system, and more particularly, to a toilet ring device for an existing toilet flange that is broken and needs to be replaced.

BACKGROUND OF THE INVENTION

A toilet is a piece of sanitary hardware that collects human urine and feces, and sometimes toilet paper, usually for disposal. Flush toilets use water, while dry or non-flush toilets do not. They can be designed for a sitting position popular in Europe and North America with a toilet seat, with additional considerations for those with disabilities, or for a squatting posture more popular in Asia (see squat toilet). In urban areas, flush toilets are usually connected to a sewer system that leads to septic tanks in isolated areas. The waste is known as blackwater and the combined effluent including other sources is sewage. Dry toilets are connected to a pit, removable container, composting chamber, or other storage and treatment device, including urine diversion with a urine-diverting toilet.

The technology used for modern toilets varies. Toilets are commonly made of ceramic (porcelain), concrete, plastic, or wood. Newer toilet technologies include dual flushing, low flushing, toilet seat warming, self-cleaning, female urinals and waterless urinals. Japan is known for its toilet technology. Airplane toilets are specially designed to operate in the air. The need to maintain anal hygiene post-defecation is universally recognized and toilet paper (often held by a toilet roll holder), which may also be used to wipe the vulva after urination, is widely used (as well as bidets).

In private homes, depending on the region and style, the toilet may exist in the same bathroom as the sink, bath, and shower. Another option is to have one room for body washing (also called "bathroom") and a separate one for the toilet and handwashing sink (toilet room). Public toilets (restrooms) consist of one or more toilets (and commonly single urinals or trough urinals) which are available for use by the general public. Products like urinal blocks and toilet blocks help maintain the smell and cleanliness of toilets. Toilet seat covers are sometimes used. Portable toilets (frequently chemical "porta johns") may be brought in for large and temporary gatherings.

Historically, sanitation has been a concern from the earliest stages of human settlements. However, many poor households in developing countries use very basic, and often unhygienic, toilets—and nearly one billion people have no access to a toilet at all; they must openly defecate and urinate. Or else they must resort to a "flying toilet": a plastic bag. These issues can lead to the spread of diseases transmitted via the fecal-oral route, or the transmission of waterborne diseases such as cholera and diarrhea. Therefore, the United Nations Sustainable Development Goal 6 wants to "achieve access to adequate and equitable sanitation and hygiene for all and end open defecation".

When toilets—commercial or residential—is taken off the floor, there is a ring called a flange that takes the waste to the sewer. In plumbing, a closet flange (also known as a toilet flange) is a pipe fitting (specifically, a type of flange) that both mounts a toilet to the floor and connects the closet bend to a drain pipe. The name comes from the term "water closet", the traditional name for a toilet. A typical closet flange is made of brass, cast iron, ABS, PVC, and lead. In a typical installation, the closet flange is mounted on top of the floor with the hub fused around the drain pipe. A wax ring (or waxless) is used to seal the gap between the flange and the bottom of the toilet. The toilet is bolted to the flange, not to the floor.

However, flooring gets weak from people sitting on the toilet. Furthermore, when the toilet is raised, the floor is raised so it's tough to put the toilet back. Moreover, replacement of a broken toilet flange does not insures a proper installation every time regarding different experience levels.

Accordingly, there is need for a solution to at least one of the aforementioned problems.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention is directed to a toilet ring device for an existing toilet flange hat is broken and needs to be replaced.

According to an embodiment of the present invention, the toilet ring device may comprise a circular plate.

According to an embodiment of the present invention, the toilet ring device may comprise an outer circular wall.

According to an embodiment of the present invention, the toilet ring device may comprise an inner circular wall.

According to an embodiment of the present invention, the circular plate, the outer circular wall and the inner circular wall may be configured to cover the existing toilet flange.

According to an embodiment of the present invention, the outer circular wall and the inner circular wall ensure that the toilet ring device does not slip.

According to an embodiment of the present invention, the circular plate, the outer circular wall and the inner circular wall may be made of stainless-steel materials.

According to an embodiment of the present invention, the circular plate, the outer circular wall and the inner circular wall may be made of aluminum materials.

According to an embodiment of the present invention, the outer circular wall may be connected with the circular plate.

According to an embodiment of the present invention, the outer circular wall may be erected from the circular plate.

According to an embodiment of the present invention, the outer circular wall may extend along an outer periphery of the circular plate.

According to an embodiment of the present invention, the toilet ring device may comprise a central hole.

According to an embodiment of the present invention, the central hole may traverse through the circular plate.

According to an embodiment of the present invention, the central hole may be configured to be aligned with central holes of the existing toilet flange and a toilet.

According to an embodiment of the present invention, the inner circular wall may be connected with the circular plate.

According to an embodiment of the present invention, the inner circular wall may be erected from the circular plate.

According to an embodiment of the present invention, the inner circular wall may extend along a periphery of the central hole.

According to an embodiment of the present invention, the toilet ring device may comprise an annular channel.

According to an embodiment of the present invention, the annular channel may be formed between the circular plate, the outer circular wall and the inner circular wall.

According to an embodiment of the present invention, the annular channel may be delineated by the circular plate, the outer circular wall and the inner circular wall.

According to an embodiment of the present invention, the toilet ring device may comprise a plurality of holes and slots.

According to an embodiment of the present invention, the plurality of holes and slots may traverse through the circular plate.

According to an embodiment of the present invention, the plurality of holes and slots may be distributed on the circular plate.

According to an embodiment of the present invention, the plurality of holes and slots may surround the central hole.

According to an embodiment of the present invention, some of the plurality of holes and slots may traverse through the outer circular wall.

According to an embodiment of the present invention, the plurality of holes and slots may be screw holes.

According to an embodiment of the present invention, the annular channel may be configured to receive the existing toilet flange.

According to an embodiment of the present invention, the plurality of holes and slots may be configured to be aligned with holes and slots of the existing toilet flange and the toilet.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

These and other objects, features, and advantages of the present invention will become more readily apparent from the attached drawings and the detailed description of the preferred embodiments, which follow.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

The preferred embodiments of the invention will hereinafter be described in conjunction with the appended drawings provided to illustrate and not to limit the invention, where like designations denote like elements, and in which:

Figure 1:
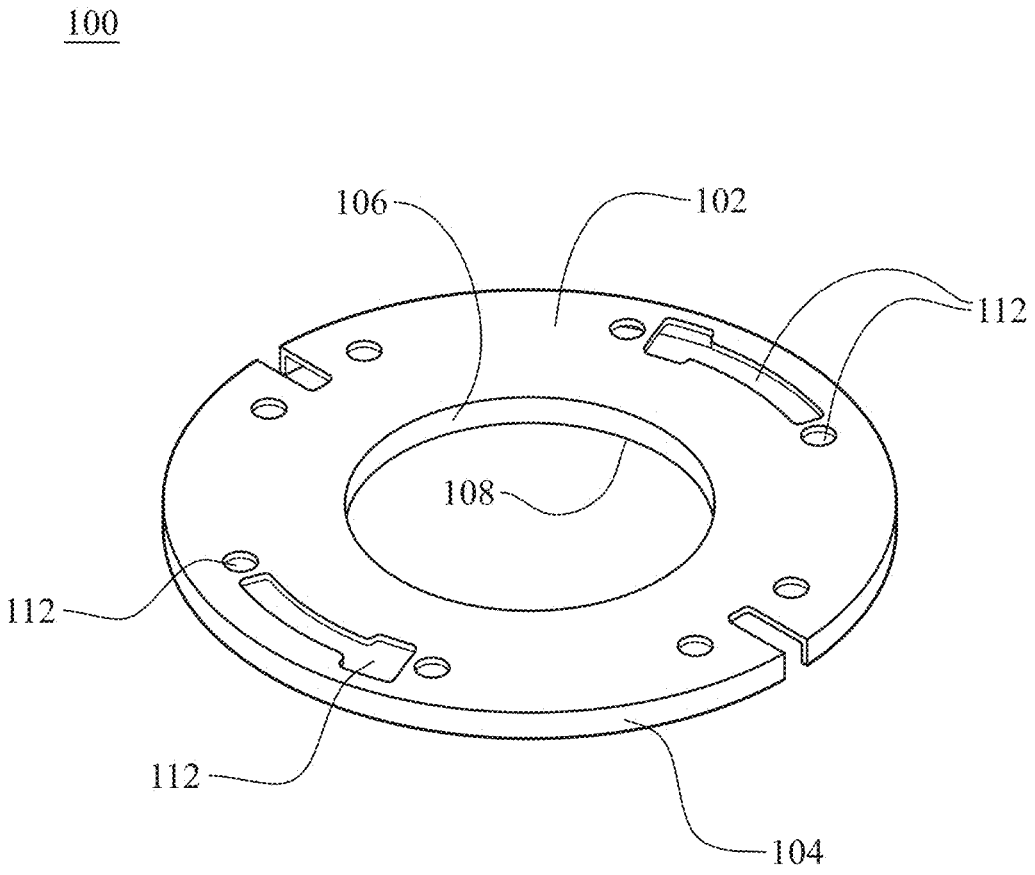
Figure 2:
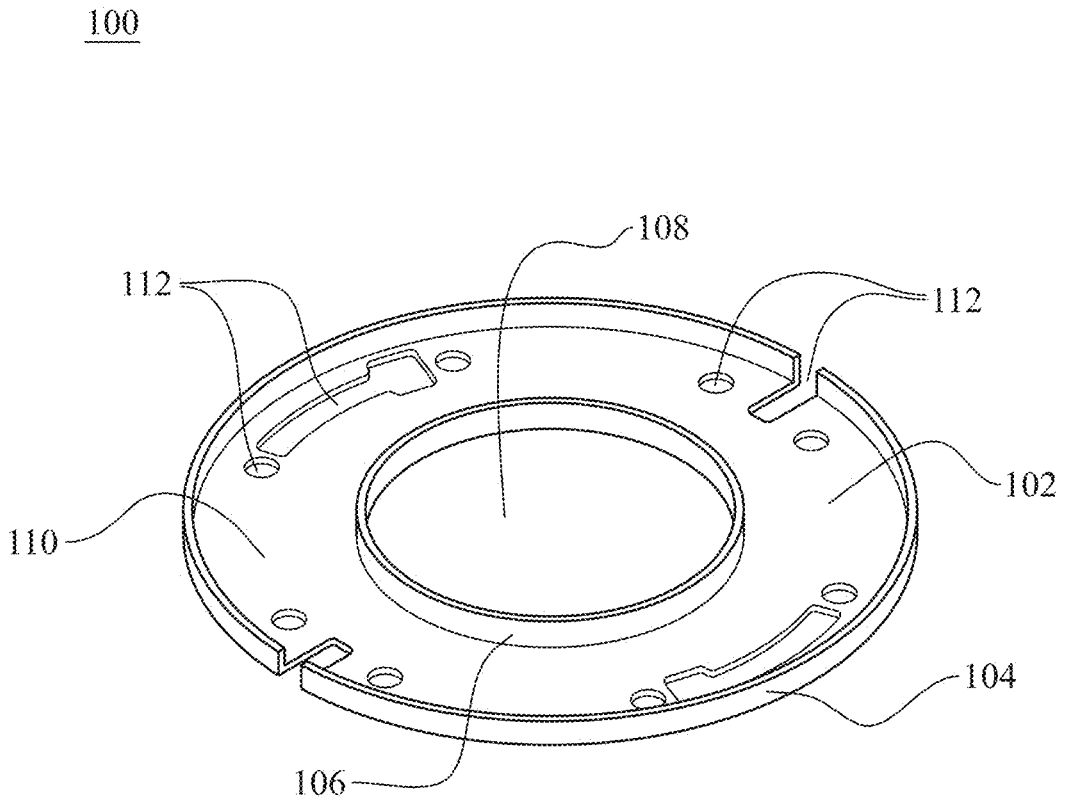
Figure 3:
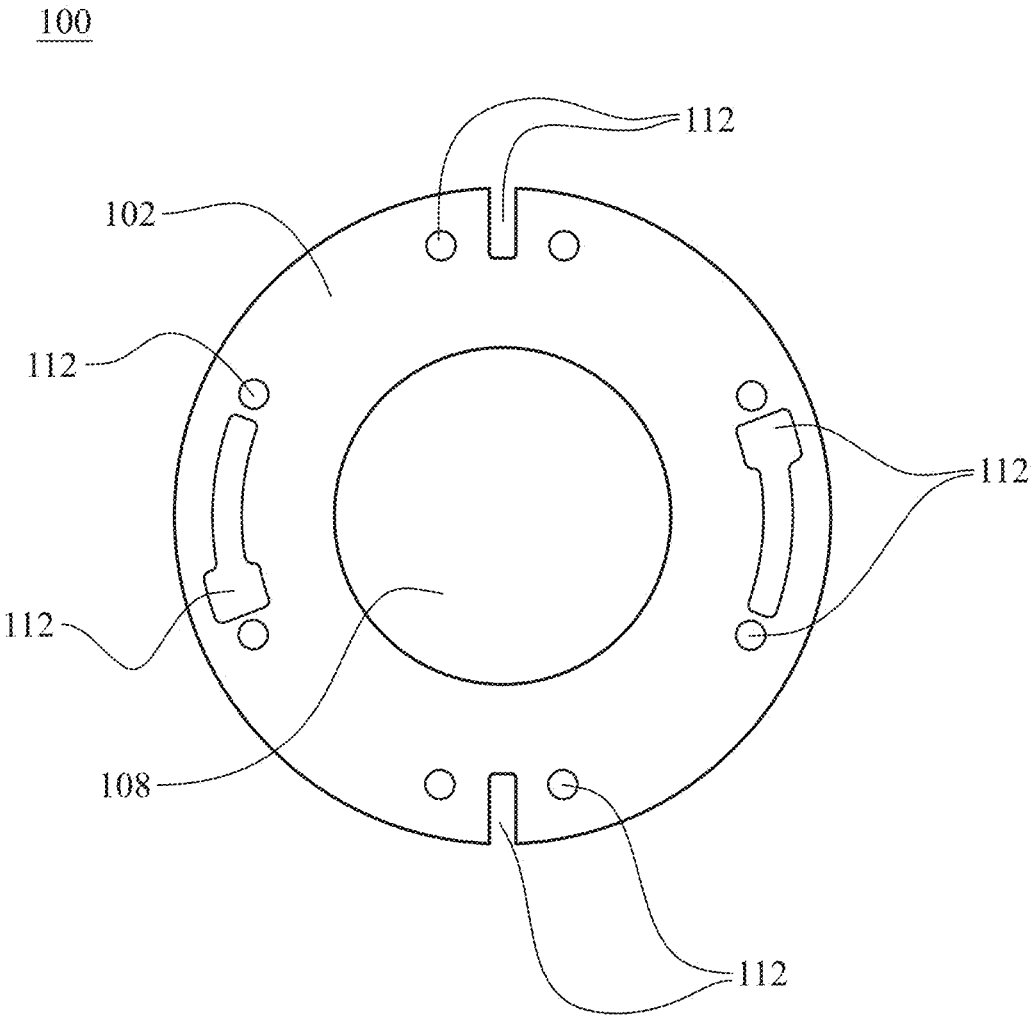
Figure 4:
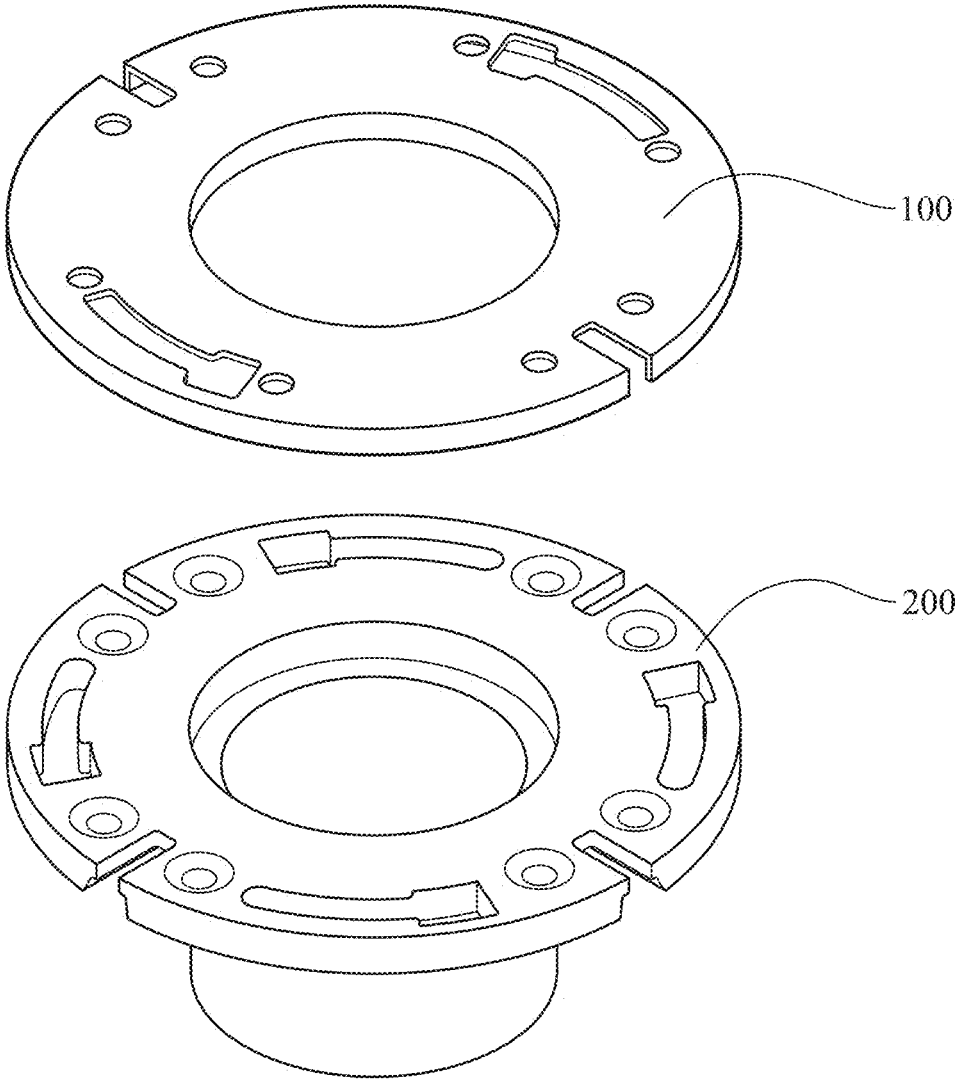
Figure 5:
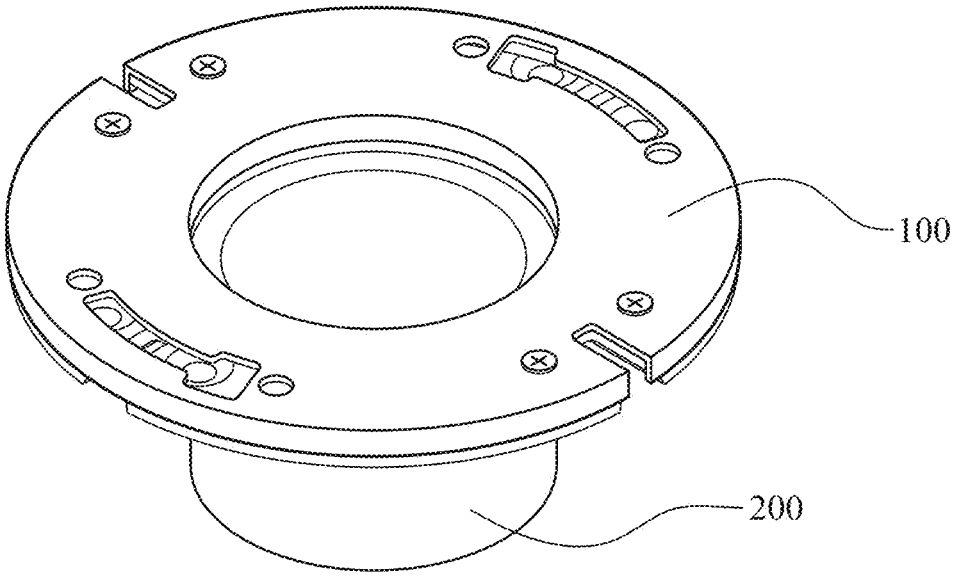
Figure 6:
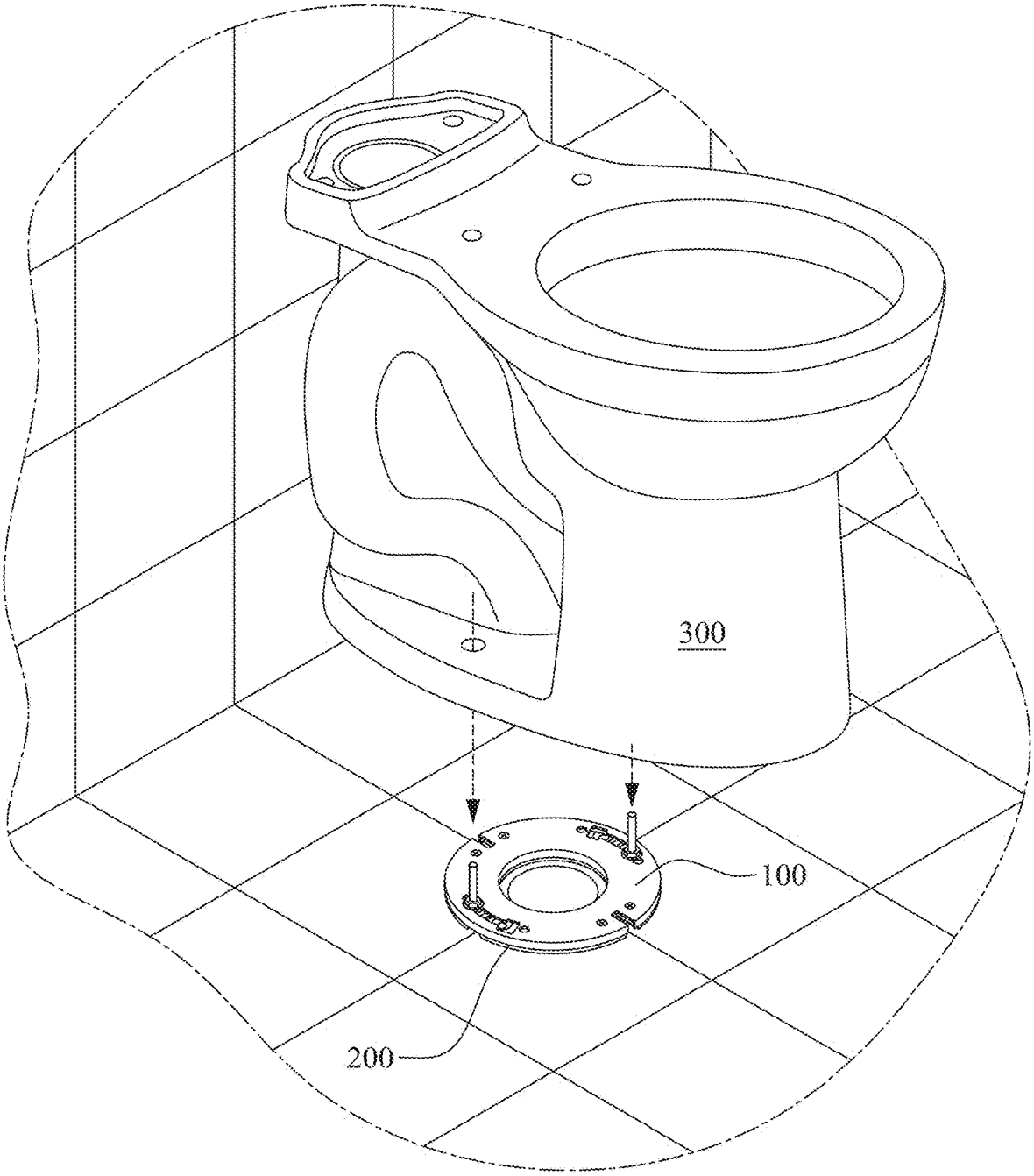

FIG. 1 presents a perspective view of a toilet ring device according to an embodiment of the present invention;

FIG. 2 presents another perspective view of a toilet ring device according to an embodiment of the present invention;

FIG. 3 presents a top view of a toilet ring device according to an embodiment of the present invention;

FIG. 4 presents a perspective view showing that a toilet ring device according to an embodiment of the present invention is used for an existing toilet flange;

FIG. 5 presents a perspective view showing that a toilet ring device according to an embodiment of the present invention is mounted on an existing toilet flange;

FIG. 6 presents a perspective view showing that a toilet ring device according to an embodiment of the present invention is used for an existing toilet flange and a toilet.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Shown throughout the figures, the present invention is directed toward a toilet ring device 100 for an existing toilet flange 200 that is broken and needs to be replaced.

According to an embodiment of the present invention, the toilet ring device 100 may comprise a circular plate 102.

According to an embodiment of the present invention, the toilet ring device 100 may comprise an outer circular wall 104.

According to an embodiment of the present invention, the toilet ring device 100 may comprise an inner circular wall 106.

According to an embodiment of the present invention, the circular plate 102, the outer circular wall 104 and the inner circular wall 106 may be configured to cover the existing toilet flange 200.

According to an embodiment of the present invention, the outer circular wall 104 and the inner circular wall 106 ensure that the toilet ring device 100 does not slip.

According to an embodiment of the present invention, the circular plate 102, the outer circular wall 104 and the inner circular wall 106 may be made of stainless-steel materials.

According to an embodiment of the present invention, the circular plate 102, the outer circular wall 104 and the inner circular wall 106 may be made of aluminum materials.

According to an embodiment of the present invention, the outer circular wall 104 may be connected with the circular plate 102.

According to an embodiment of the present invention, the outer circular wall 104 may be erected from the circular plate 102.

According to an embodiment of the present invention, the outer circular wall 104 may extend along an outer periphery of the circular plate 102.

According to an embodiment of the present invention, the toilet ring device 100 may comprise a central hole 108.

According to an embodiment of the present invention, the central hole 108 may traverse through the circular plate 102.

According to an embodiment of the present invention, the central hole 108 may be configured to be aligned with central holes of the existing toilet flange 200 and a toilet 300.

According to an embodiment of the present invention, the inner circular wall 106 may be connected with the circular plate 102.

According to an embodiment of the present invention, the inner circular wall 106 may be erected from the circular plate 102.

According to an embodiment of the present invention, the inner circular wall 106 may extend along a periphery of the central hole 108.

According to an embodiment of the present invention, the toilet ring device 100 may comprise an annular channel 110.

According to an embodiment of the present invention, the annular channel 110 may be formed between the circular plate 102, the outer circular wall 104 and the inner circular wall 106.

According to an embodiment of the present invention, the annular channel 110 may be delineated by the circular plate 102, the outer circular wall 104 and the inner circular wall 106.

According to an embodiment of the present invention, the toilet ring device 100 may comprise a plurality of holes and slots 112.

According to an embodiment of the present invention, the plurality of holes and slots 112 may traverse through the circular plate 102.

According to an embodiment of the present invention, the plurality of holes and slots 112 may be distributed on the circular plate 102.

According to an embodiment of the present invention, the plurality of holes and slots 112 may surround the central hole 108.

According to an embodiment of the present invention, some of the plurality of holes and slots 112 may traverse through the outer circular wall 104.

According to an embodiment of the present invention, the plurality of holes and slots 112 may be screw holes.

According to an embodiment of the present invention, the annular channel 110 may be configured to receive the existing toilet flange 200.

According to an embodiment of the present invention, the plurality of holes and slots 112 may be configured to be aligned with holes and slots of the existing toilet flange 200 and the toilet 300.

The toilet ring device 100 may provide stability and support for the toilet 300 and the surrounding flooring, while alleviating the need to fully replace the existing toilet flange 200 that is broken and damaged.

Instead of replacing the existing toilet flange 200 when needed, a plumber can just install the toilet ring device 100 over the while not disturbing regular plumbing.

In use, the toilet 300 is removed off the floor, the existing toilet flange 200 is cleaned, some silicone is placed, the toilet ring device 100 is attached over the existing toilet flange 200, and then the toilet 300 is placed back on top of the toilet ring device 100.

The toilet ring device 100 protects the flooring from damage due to normal wear and tear from sitting down on the toilet 300 and protects the plumbing.

Moreover, the toilet ring device 100 minimally raises the floor (base of the toilet 300) needing to be replaced.

With skill sets varying from one plumber to the next and many applications and parts to make a flange repair, the toilet ring device 100 insures a proper installation every time regardless of experience level.

The toilet ring device 100 minimally raises height of the existing toilet flange 200 so installation is complete without compromising the wax seal gap.

The toilet ring device 100 is securely fastened to the existing toilet flange 200 and floor by rigid stainless-steel or aluminum materials ensuring the repair will stand the test of time.

Installation of the toilet ring device 100 saves time and is simple for professional use.

The toilet ring device 100 simplifies and removes several labor-intensive steps and processes; saving energy and time on the job.

The toilet ring device 100 insures peace of mind for the installer and the homeowner with a trustable repair.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A toilet ring device configured to be installed over an existing toilet flange of a toilet which is broken, the existing toilet flange having a center hole formed therethrough, the toilet ring device comprising:

a circular plate made of at least one of stainless-steel or aluminum, the circular plate having an upper surface and a lower surface;

a central hole formed through the circular plate configured to align with the center hole through the existing toilet flange;

an outer circular wall extending downwardly from and forming a 90 degree angle with the lower surface of the circular plate along an outer periphery of the circular plate;

an inner circular wall extending downwardly from and forming a 90 degree angle with the lower surface of the circular plate along a periphery of the central hole formed through the circular plate;

the circular plate, the outer circular wall, and the inner circular wall comprising a singular unitary construction with one another;

an annular channel formed between the outer circular wall and the inner circular wall, the annual channel having an outer diameter which is greater than a diameter of the existing toilet flange and an inner diameter which is less than a diameter of the center hole though the existing toilet flange, the annular channel dimensioned and configured to be positioned over and receive the existing toilet flange therein; wherein the inner circular wall is configured to be received in the center hole through the existing toilet flange when the existing toilet flange is received in the annual channel;

a first pair of elongated slots formed through the circular plate on opposite sides of the central hole, each of the first pair of elongated slots having an enlarged opening formed through the circular plate at a proximal end and an oppositely disposed distal end;

a plurality of first holes formed through the circular plate, one of the plurality of first holes disposed adjacent each of the proximal end and the oppositely disposed distal end of each of the first pair of elongated slots;

a second pair of elongated slots formed through the circular plate and extending outwardly through a portion of the outer circular wall, each of the second pair of elongated slots formed between the proximal end of one of the first pair of elongated slots and the distal end of the other of the first pair of elongated slots, wherein the second pair of elongated slots are disposed 180 degrees apart from one another; and a plurality of second holes formed through the circular plate, one of the plurality of second holes disposed adjacent each side of each of the second pair of elongated slots.

2. The toilet ring device of claim 1, wherein the circular plate, the outer circular wall, and the inner circular wall are configured to cover the existing toilet flange.

3. The toilet ring device of claim 1, wherein the outer circular wall and the inner circular wall ensure that the toilet ring device does not slip.

4. The toilet ring device of claim 1, wherein the plurality of first holes and the plurality of second holes are screw holes.

5. The toilet ring device of claim 1, wherein the circular plate is made of stainless steel.

6. The toilet ring device of claim 1, wherein the circular plate is made of aluminum.

7. A toilet ring device configured to be installed over an existing toilet flange of a toilet which is broken, the existing toilet flange having a center hole formed therethrough, the toilet ring device comprising:

a circular plate made exclusively of stainless-steel the circular plate having an upper surface and a lower surface;

a central hole formed through the circular plate configured to align with the center hole through the existing toilet flange;

an outer circular wall made exclusively of stainless-steel and extending downwardly from and forming a 90 degree angle with the lower surface of the circular plate;

an inner circular wall made exclusively of stainless-steel and extending downwardly from and forming a 90 degree angle with the lower surface of the circular plate;

the circular plate, the outer circular wall, and the inner circular wall comprising a singular unitary construction with one another;

an annular channel formed between the outer circular wall and the inner circular wall the annual channel having an outer diameter which is greater than a diameter of the existing toilet flange and an inner diameter which is less than a diameter of the center hole though the existing toilet flange, the annular channel dimensioned and configured to be positioned over and receive the existing toilet flange therein; wherein the inner circular wall is configured to be received in the center hole through the existing toller flange when the existing toilet flange is received in the annual channel;

a first pair of elongated slots formed through the circular plate on opposite sides of the central hole, each of the first pair of elongated slots having an enlarged opening formed through the circular plate at a proximal end and an oppositely disposed distal end;

a plurality of first holes formed through the circular plate, one of the plurality of first holes disposed adjacent each of the proximal end and the oppositely disposed distal end of each of the first pair of elongated slots;

a second pair of elongated slots formed through the circular plate and extending outwardly through a portion of the outer circular wall, each of the second pair of elongated slots formed between the proximal end of one of the first pair of elongated slots and the distal end of the other of the first pair of elongated slots, wherein the second pair of elongated slots are disposed 180 degrees apart from one another;

a plurality of second holes formed through the circular plate, one of the plurality of second holes disposed adjacent each side of each of the second pair of elongated slots; and at least some of the first pair of elongated slots, the plurality of first holes, the second pair of elongated slots, and the plurality of second holes align with holes and slots of the existing toilet flange of the toilet.

8. A toilet ring device configured to be installed over an existing toilet flange of a toilet which is broken, the existing toilet flange having a center hole formed therethrough, the toilet ring device comprising:

a circular plate made exclusively of stainless-steel, designed-to-cover-the-existing-toilet Bange the circular plate having an upper surface and a lower surface, a central hole formed through the circular plate configured to align with the center hole through the existing toilet flange;

an outer circular wall made exclusively of stainless-steel extending downwardly from and forming a 90 degree angle with the lower surface of the circular plate, and ensuring non-slippage of the device;

an inner circular wall made exclusively of stainless-steel extending downwardly from and forming a 90 degree angle with the lower surface of the circular plate, and ensuring non-slippage of the device;

the circular plate, the outer circular wall, and the inner circular wall comprising a singular unitary construction with one another;

an annular channel formed between the outer circular wall and the inner circular wall, the annual channel having an outer diameter which is greater than a diameter of the existing toilet flange and an inner diameter which is less than a diameter of the center hole though the existing toilet flange, the annular channel dimensioned and configured to be positioned over and receive the existing toilet flange therein, wherein the inner circular wall is configured to be received in the center hole through the existing toilet flange when the existing toilet flange is received in the annual channel;

a pair of elongated curvilinear slots formed through the circular plate on opposite sides of the central hole, each of the pair of elongated curvilinear slots having an enlarged opening formed through the circular plate at a proximal end and an oppositely disposed distal end;

a plurality of first holes formed through the circular plate, one of the plurality of first holes disposed adjacent each of the proximal end and the oppositely disposed distal end of each of the pair of elongated curvilinear slots;

a pair of elongated linear slots formed through the circular plate and extending outwardly through a portion of the outer circular wall, each of the pair of elongated linear slots formed between the proximal end of one of the pair of elongated curvilinear slots and the distal end of the other of the pair of elongated curvilinear slots, wherein the second pair of elongated slots are disposed 180 degrees apart from one another;

a plurality of second holes formed through the circular plate, one of the plurality of second holes disposed adjacent each side of each of the pair of elongated linear slots; at least some of the pair of elongated curvilinear slots, the plurality of first holes, the pair of elongated linear slots, and the plurality of second holes align with holes and slots of the existing toilet flange and the toilet; and the annular channel delineated by the circular plate, the outer circular wall, and the inner circular wall, and configured to snugly receive the existing toilet flange therein.

* * * * *